US009644460B2

(12) United States Patent
Bell et al.

(10) Patent No.: US 9,644,460 B2
(45) Date of Patent: May 9, 2017

(54) METHOD FOR THE ENHANCEMENT OF INJECTION ACTIVITIES AND STIMULATION OF OIL AND GAS PRODUCTION

(71) Applicant: GEODynamics, Inc., Millsap, TX (US)

(72) Inventors: Matthew Robert George Bell, Millsap, TX (US); David S. Wesson, Millsap, TX (US); Nathan Garret Clark, Millsap, TX (US); John Thomas Hardesty, Millsap, TX (US)

(73) Assignee: GEODynamics, Inc., Millsap, TX (US)

( * ) Notice: Subject to any disclaimer, the term of this patent is extended or adjusted under 35 U.S.C. 154(b) by 0 days.

(21) Appl. No.: 15/180,614

(22) Filed: Jun. 13, 2016

(65) Prior Publication Data

US 2016/0341018 A1 Nov. 24, 2016

Related U.S. Application Data

(63) Continuation of application No. 12/627,693, filed on Nov. 30, 2009, now abandoned.

(Continued)

(51) Int. Cl.
*E21B 43/117* (2006.01)
*E21B 43/263* (2006.01)

(Continued)

(52) U.S. Cl.
CPC ..... *E21B 43/117* (2013.01); *E21B 37/00* (2013.01); *E21B 43/248* (2013.01); *E21B 43/26* (2013.01); *E21B 43/263* (2013.01)

(58) Field of Classification Search
CPC .... E21B 43/116; E21B 43/117; E21B 43/263; E21B 43/248
See application file for complete search history.

(56) References Cited

U.S. PATENT DOCUMENTS 3,188,955 A 6/1965 Brown
3,235,005 A 2/1966 Delacour (Continued)

FOREIGN PATENT DOCUMENTS

DE 10200559934 A1 8/2006
WO 03042625 5/2003

(Continued)

OTHER PUBLICATIONS

DYNAenergetics Flyer "Don't Miss Out on Improved Perforation!" (4 pages).

(Continued)

*Primary Examiner* — Cathleen Hutchins
(74) *Attorney, Agent, or Firm* — David W. Carstens; Shaukat A. Karjeker; Carstens & Cahoon, LLP

(57) ABSTRACT

By removing material of low permeability from within and around a perforation tunnel and creating at least one fracture at the tip of a perforation tunnel, injection parameters and effects such as outflow rate and, in the case of multiple perforation tunnels benefiting from such cleanup, distribution of injected fluids along a wellbore are enhanced. Following detonation of a charge carrier, a second explosive event is triggered within a freshly made tunnel, thereby substantially eliminating a crushed zone and improving the geometry and quality (and length) of the tunnel. In addition, this action creates substantially debris-free tunnels and relieves the residual stress cage, resulting in perforation tunnels that are highly conducive to injection under fracturing conditions for disposal and stimulation purposes, and that promote even coverage of injected fluids across the perforated interval.

33 Claims, 11 Drawing Sheets

Related U.S. Application Data

(60) Provisional application No. 61/118,992, filed on Dec. 1, 2008.

(51) Int. Cl.

| | |
|---|---|
| ***E21B 43/248*** | (2006.01) |
| ***E21B 37/00*** | (2006.01) |
| ***E21B 43/26*** | (2006.01) |

(56) References Cited

U.S. PATENT DOCUMENTS

| | | | | |
|---|---|---|---|---|
| 3,983,941 | A | 10/1976 | Fitch | |
| 4,078,612 | A | 3/1978 | Gallus | |
| 4,107,057 | A | 8/1978 | Dill et al. | |
| 4,220,205 | A | 9/1980 | Coursen et al. | |
| 4,372,384 | A | 2/1983 | Kinney | |
| 5,318,128 | A | 6/1994 | Johnson et al. | |
| 5,551,344 | A | 9/1996 | Couet et al. | |
| 5,567,906 | A | 10/1996 | Reese et al. | |
| 6,336,506 | B2 | 1/2002 | Wesson | |
| 6,386,288 | B1 | 5/2002 | Snider et al. | |
| 6,598,682 | B2 | 7/2003 | Johnson et al. | |
| 6,962,203 | B2 | 11/2005 | Funchess | |
| 7,036,594 | B2 | 5/2006 | Walton et al. | |
| 7,165,614 | B1 | 1/2007 | Bond | |
| 7,278,354 | B1 * | 10/2007 | Langan | C06B 45/14 102/306 |
| 7,393,423 | B2 | 7/2008 | Liu | |
| 7,712,416 | B2 | 5/2010 | Pratt et al. | |
| 7,775,279 | B2 | 8/2010 | Marya et al. | |
| 8,544,563 | B2 | 10/2013 | Bourne et al. | |
| 9,080,431 | B2 | 7/2015 | Bell et al. | |
| 2003/0037692 | A1 | 2/2003 | Liu | |
| 2003/0089498 | A1 | 5/2003 | Johnson et al. | |
| 2004/0089449 | A1 | 5/2004 | Walton et al. | |
| 2005/0056459 | A1 | 3/2005 | Haney et al. | |
| 2005/0115448 | A1 | 6/2005 | Pratt et al. | |
| 2006/0118301 | A1 | 6/2006 | East et al. | |
| 2006/0266551 | A1 | 11/2006 | Yang et al. | |
| 2007/0056462 | A1 | 3/2007 | Bates et al. | |
| 2008/0230225 | A1 | 9/2008 | Meddes et al. | |
| 2008/0271894 | A1 | 11/2008 | Hill et al. | |
| 2008/0282924 | A1 * | 11/2008 | Saenger | E21B 37/08 102/306 |
| 2010/0132946 | A1 | 6/2010 | Bell et al. | |

FOREIGN PATENT DOCUMENTS

| | | | |
|---|---|---|---|
| WO | 2005035939 | A1 | 4/2005 |
| WO | 2008102110 | A1 | 8/2008 |

OTHER PUBLICATIONS

American Petroleum Instatute Registered Data Sheet Perforating System Evaluation, API RP 19B Section 1 Spreadsheet for DYNAenergetics (1 pages).

Connex Perforating "ReActive Perforating Technology" 2008 GEODynamics, Inc. (9 pages).

Power Point Presentation entitled "Technology/Product Preview" dated Apr. 30, 2007 by GEODynamics (35 pages).

GEODynamics Engineered Perforating Solutions, 2009 GEODynamics Inc., Client Spotlight, Jul. 2009.

GEODynamics Engineered Perforating Solutions, Oct. 2008. GEODynamics, Inc., CONNEX Perforating, ReActive Perforating Technology.

Bell, Hardesty, and Clark, "Reactive Perforating: Conventional and Unconventional Applications, Learnings, and Opportunities," SPE 122174, 2009 Society of Petroleum Engineers, May 27, 2009.

Bell and Cuthill, "Next-Generation Perforating System Enhances the Testing and Treatment of Fracture Stimulated Wells in Canada," SPE 116226, 2008, Society of Petroleum Engineers, Sep. 21, 2008.

Denney, "Technology Applications," JPT Online, Jul. 2007, located at http://www.spe.org/spe-app/spe/jpt/2007/07/TechApps.htm, downloaded Nov. 28, 2009.

Yang, et al. "Flow Performance of Perforation Tunnels Created With Shaped Charges Using Reactive Liner Technology", SPE 121931, SPE International, Society of Petroleum Engineers, 2009, pp. 1-17.

Wade et al. "Field Tests Indicate New Perforating Devices Improve Efficiency in Casing Completion Operations" Schlumberger Well Surveying Corp. Oct. 1962, pp. 1069-1073.

GEODynamics "Technology/Product Preview" Presentation at OCT Luncheon by Wesson and Bell, presented Apr. 30, 2007 (35 pages).

DynaEnergetics' 26g DPEX St HMX Shaped Charge, Sep. 2007 (4 pages).

Bartz et al., "Let's Get the Most Out of Existing Wells", Oilfield Review, pp. 2-21 (1997).

* cited by examiner

METHOD FOR THE ENHANCEMENT OF INJECTION ACTIVITIES AND STIMULATION OF OIL AND GAS PRODUCTION

CROSS-REFERENCE TO RELATED APPLICATION

This application is a continuation of and claims priority from U.S. application Ser. No. 12/627,693 filed Nov. 30, 2009, which is a non-provisional application of Provisional Application No. 61/118,992, filed Dec. 1, 2008, the disclosures of which are herein incorporated by reference.

TECHNICAL FIELD

The present invention relates generally to reactive shaped charges used in the oil and gas industry to explosively perforate well casing and underground hydrocarbon bearing formations, and more particularly to an improved method for explosively perforating a well casing and its surrounding underground hydrocarbon bearing formation prior to injecting fluids or gases, enhancing the effects of the injection and the injection parameters.

BACKGROUND OF THE INVENTION

Injection activities are a required practice to enhance and ensure the productivity of oil and gas fields, especially in environments where the natural production potential of the reservoir is limited (e.g. low-permeability formations). Generally, injection activities use special chemical solutions to improve oil recovery, remove formation damage, clean blocked perforations or formation layers, reduce or inhibit corrosion, upgrade crude oil, or address crude oil flow-assurance issues. Injection can be administered continuously, in batches, in injection wells, or at times in production wells.

In a majority of cases, wells that will be subject to injection activities are completed with a cemented casing across the formation of interest to assure borehole integrity and allow selective injection into and/or production of fluids from specific intervals within the formation. It is necessary to perforate this casing across the interval(s) of interest to permit the ingress or egress of fluids. Several methods are applied to perforate the casing, including mechanical cutting, hydro-jetting, bullet guns and shaped charges. The preferred solution in most cases is shaped charge perforation because a large number of holes can be created simultaneously, at relatively low cost. Furthermore, the depth of penetration into the formation is sufficient to bypass near-wellbore permeability reduction caused by the invasion of incompatible fluids during drilling and completion. The vast majority of perforated completions depend on the use of shaped charges because of the relative speed and simplicity of their deployment compared to alternatives, such as mechanical penetrators or hydro-abrasive jetting tools. However, despite these advantages shaped charges provide an imperfect solution.

FIG. 1A illustrates a perforating gun 10 consisting of a cylindrical charge carrier 14 with shaped charges 16 (also known as perforators) lowered into the well by means of a cable, wireline, coil tubing or assembly of jointed pipe 18. Any technique known in the art may be used to deploy the carrier 14 into the well casing. At the well site, the shaped charges 16 are placed into the charge carrier 14, and the charge carrier 14 is then lowered into the oil and gas well casing to the depth of a hydrocarbon bearing formation 12.

FIG. 1B depicts a blown-up view of a conventional shaped charge 16 next to a hydrocarbon bearing formation 12, as referenced in FIG. 1A. The shaped charge 16 is formed by compressing explosive powder (also known as an explosive load) 22 within a metal case 20 using a conical or parabolic metal liner 24. When the explosive powder 22 is detonated, the symmetry of the charge 16 causes the metal liner 24 to collapse along its axis into a narrow, focused jet of fast moving metal particles. Consequently, the shaped charge 16 will perforate the carrier 14, casing 26, cement sheath 28, and finally the formation 12. As the charge jet penetrates the rock it decelerates until eventually the jet tip velocity falls below the critical velocity required for it to continue penetrating.

Perforation is inevitably a violent event, pulverizing formation rock grains and resulting in plastic deformation of the penetrated rock, grain fracturing, and the compaction of particulate debris (fractured sand grains, cement particles, and/or metal particles from casing, shaped charge fragments or the disintegrating liner) into the tunnel and the pore throats of rock surrounding the tunnel. As seen in the tunnels 32 of FIG. 2, particulate debris 38 resulting from perforation can cause any number of blockages, ranging from entirely blocking an opening 34 to a tunnel 32 or substantially filling the area of the tunnel 32, for example. This debris 38 can limit the effectiveness of the created tunnel as a conduit for flow since debris inside the perforation tunnel and embedded into the wall of the tunnel may block the ingress or egress of fluids or gases. This may cause significant operational difficulties for the well operator and the debris may have to be cleaned out of the tunnels at significant cost.

FIG. 3A depicts a close-up view detailing the typical tunnel after a traditional shaped charge 16 is fired from a perforating gun 14 and into a hydrocarbon bearing formation 12 as shown in FIG. 2. As shown in FIG. 3A, the resulting tunnel 32 created through the hole 34 in the casing wall is relatively narrow. Particulate jet debris 38 and material from the formation 12 piles up at the tip 30 of the newly created tunnel 32. This compacted mass of debris 38, enlarged in FIG. 3B, at the tip 30 of the tunnel is typically very hard and almost impermeable, reducing the inflow and/or outflow potential of the tunnel and the effective tunnel depth, $r_e$ (also known as clear tunnel depth). Plugged tips 30 impair flow and obstruct the production of oil and gas from the well. In addition, the particulate debris that the perforating event drives into the surrounding pore throats results in a zone 36 of reduced permeability (disturbed rock) around the perforation tunnel 32 commonly known as the "crushed zone," which typically contains pulverized and compacted rock. The crushed zone 36, though only about one quarter inch thick around the tunnel, detrimentally affects the inflow and/or outflow potential of the tunnel 32 (commonly known as a "skin" effect.) Plastic deformation of the rock during perforation also results in a semi-permanent zone 42 of increased stress around the tunnel, known as a "stress cage", which impairs fracture initiation from the tunnel. The perforating event is so fast that the associated rock deformation and compaction exceed the elastic limit of the rock and result in permanent plastic deformation. Along with changes in porosity and permeability, the in-situ stress in the plastically deformed rock is also substantially changed, forming the stress cage 42 extending up to several inches beyond the actual dimensions of the tunnel.

The distance a perforated tunnel extends into the surrounding formation, commonly referred to as total penetration, is a function of the explosive weight of the shaped charge; the size, weight, and grade of the casing; the prevailing formation strength; and the effective stress acting on the formation at the time of perforating. Effective penetration is the fraction of the total penetration that contributes to the inflow or outflow of fluids. This is determined by the amount of compacted debris left in the tunnel after the perforating event is completed. The effective penetration may vary significantly from perforation to perforation. Currently, there is no means of measuring it in the borehole. Darcy's law relates fluid flow through a porous medium to permeability and other variables, and is represented by the equation seen below:

$$q = \frac{2\pi kh(p_e - p_w)}{\mu\left[\ln\left(\frac{r_e}{r_w}\right) + S\right]}$$

Where: q=flowrate, k=permeability, h=reservoir height, $p_e$=pressure at the reservoir boundary, $p_w$=pressure at the wellbore, μ=fluid viscosity, $r_e$=radius of the reservoir boundary, $r_w$=radius of the wellbore, and S=skin factor.

The effective penetration determines the effective wellbore radius, $r_w$, an important term in the Darcy equation for the radial inflow. This becomes even more significant when near-wellbore formation damage has occurred during the drilling and completion process, for example, resulting from mud filtrate invasion. If the effective penetration is less than the depth of the invasion, fluid flow can be seriously impaired.

To optimize the production potential of a tunnel, current methods rely on either remedial operations during or after the perforation or modification of the system configuration. For example, current procedures commonly rely on the creation of a relatively large static pressure differential, or underbalance, between the formation and the wellbore, wherein the formation pressure is greater than the wellbore pressure. These methods attempt to enhance tunnel cleanout by controlling the static and dynamic pressure behavior within the wellbore prior to, during and immediately following the perforating event so that a pressure gradient is maintained from the formation toward the wellbore, inducing tensile failure of the damaged rock around the tunnel and a surge of flow to transport debris from the perforation tunnels into the wellbore. Underbalanced perforating involves creating the opening through the casing under conditions in which the hydrostatic pressure inside the casing is less than the reservoir pressure, allowing the reservoir fluid to flow into the wellbore. If the reservoir pressure and/or formation permeability is low, or the wellbore pressure cannot be lowered substantially, there may be insufficient driving force to remove the debris. Such techniques are relatively successful in homogenous formations of moderate to high natural permeability (typically 300 millidarcies and greater), where a sufficient surge flow can be induced to clean a majority of the perforation tunnels. In such cases, the percentage of tunnels left unobstructed (also known as "perforation efficiency") may typically be 50-75% of the total holes perforated. Furthermore, laboratory experiments indicate that the clear tunnel depth of "clean" perforations created in an underbalanced situation generally varies between 50-90% of the total penetration.

In heterogeneous formations—where rock properties such as hardness and permeability vary significantly within the perforation interval—and in formations of high-strength, high effective stress and/or low natural permeability, underbalanced techniques become increasingly less effective. Since all the tunnels are being cleaned up in parallel by a common pressure sink, perforations shot into zones of relatively higher permeability will preferentially flow and clean up, eliminating the pressure gradient before adjacent perforations shot into poorer rock are able to flow.

Since the maximum pressure gradient is limited by the difference between the reservoir pressure and the minimum hydrostatic pressure that can be achieved in the wellbore, perforations shot into low permeability rock may never experience sufficient surge flow to clean up. In such circumstances the perforation efficiency may be as low as 10% of the total holes perforated.

In low to moderate-permeability reservoirs, a hydraulic fracture is commonly used for well stimulation to bypass near-wellbore damage, increase the effective wellbore radius, and increase the overall connectivity between the reservoir and the wellbore. Execution of a hydraulic fracture involves the injection of fluids at a pressure sufficiently high to cause tensile failure of the rock. At the fracture initiation pressure, often known as the "breakdown pressure," the rock opens. As additional fluids are injected, the opening is extended and the fracture propagates. When properly executed, a hydraulic fracture results in a "path," connected to the well that has a much higher permeability than the surrounding formation. This path of large permeability can extend tens to hundreds of feet from the wellbore.

Perforations play a critical role in any stimulation treatment because they form the only connection between the wellbore and formation. However, arriving at an optimum perforation design can be difficult because essentially all perforated completions are damaged, as shown by way of example in FIGS. 2-3. The compacted and plastically deformed zones around the perforation can be so highly stressed that the pressure required to initiate a fracture is significantly greater than the measured fracture gradient of the unaltered rock. In extreme cases the altered rock cannot be broken down before surface equipment limitations are reached. When breakdown is possible, the induced fracture will orient itself parallel to the minimum stress acting on the formation 12. This may result in a tortuous path as depicted in FIG. 4, resulting in increased near-wellbore pressure losses, commonly known as tortuosity.

In FIG. 4, the uneven and inefficient injection and/or stimulation that results with prior art methods is seen. As chemical solutions are introduced, debris 38 prevents their introduction through plugged tunnels, causing poor coverage across the targeted formation interval. The limited number of open perforation tunnels forces fluids to find tortuous pathways around the partially blocked tunnels. Furthermore, a high percentage of blocked tunnels means that only relatively few open tunnels will be aligned with the preferred fracture plan, which is determined by the prevailing stress regime in the rock. Re-orientation of the fracture to the preferred fracture plane after initiating in the direction of the open tunnels will result in additional tortuosity. Such tortuosity is a primary cause of excessive injection pressure, premature screenout, and incomplete fracture stimulation treatment execution.

Thus, inadequately cleaned tunnels limit the outflow area through which injection fluids can flow; inhibit injection rates at a given injection pressure; impair fracture initiation and propagation; increase the flux rate per open perforation, causing unwanted, increased erosion; and increase the risk that solids bridging across the open perforations will eventually result in catastrophic loss of injectivity (also known as "screen out"). Further, it becomes very difficult to accurately predict the outflow area created by a given set of perforations and the discussed prior art methods do not remedy the uncertainties associated with damaged perforation tunnels.

Consequently, there is a need for a method of reducing the effects experienced when using conventional perforators in heterogeneous formations. There is also a need for a method of reducing the effects of plastic deformation in moderate to high strength rocks and enhancing perforation cleanup, preferably achieved as part of the primary perforating operation and not by introducing additional operation complexity or cost. Further, there is a need for a method of enhancing the parameters and effects of injection to enhance and stimulate the production of oil and gas.

SUMMARY OF THE INVENTION

While current pre-stimulation procedures do not tend to rely on the quality of the tunnel—that is, whether or not it is plugged and/or damaged—for pre-stimulation activities, it has been found that the geometry of a tunnel will determine the effectiveness and reliability of the fracture treatment. The present application provides an improved method for the perforation of a wellbore, which substantially eliminates the crushed zone and preferably fractures the end or tip of a perforation tunnel (referred to also as creating one or more tip fractures), resulting in improved perforation efficiency and effective tunnel cleanout. This method minimizes near-wellbore pressure losses during injection, improves the distribution of injected fluid across the perforated interval, reduces the pressure required to initiate an hydraulic fracture, and reduces tortuosity effects in fractures created during fracturing operations.

Generally, the method comprises the steps of loading one or more reactive shaped charges within a charge carrier, positioning the charge carrier down a wellbore adjacent to an underground formation, and detonating the shaped charges. Upon detonation, a first and second explosive event is created. The first explosive event creates one or more perforation tunnels within the adjacent formation, each of said one or more perforation tunnels surround by a crushed zone. The second explosive event induces at least one fracture at the tip of at least one perforation tunnel.

In one embodiment, the crushed zone is eliminated by exploiting chemical reactions. By way of example, and without limitation, the chemical reaction between a molten metal and an oxygen-carrier such as water is produced to create an exothermic reaction within and around a perforation tunnel after detonation of a perforating gun. In a second and preferred embodiment, a strong exothermic intermetallic reaction between shaped charge liner components within and around a perforation tunnel eliminates the crushed zone. Preferably, the secondary reactions induced also create at least one fracture at the tip (or end) of a tunnel.

By fracturing the tip of a perforation tunnel, the residual stress cage caused by plastic deformation of the rock during creation of the tunnel is relieved, reducing the fluid pressure required to initiate a fracture during subsequent injection activity. By removing the crushed zone debris from a perforation tunnel, the inflow and/or outflow potential therefrom is significantly enhanced and further benefits are achieved. Without limiting the scope of the invention, the present method enhances a number of injection activities, which are further discussed below.

BRIEF DESCRIPTION OF THE DRAWINGS

A more complete understanding of the method and apparatus of the present invention may be had by reference to the following detailed description when taken in conjunction with the accompanying drawings, wherein.

Figure 1A:
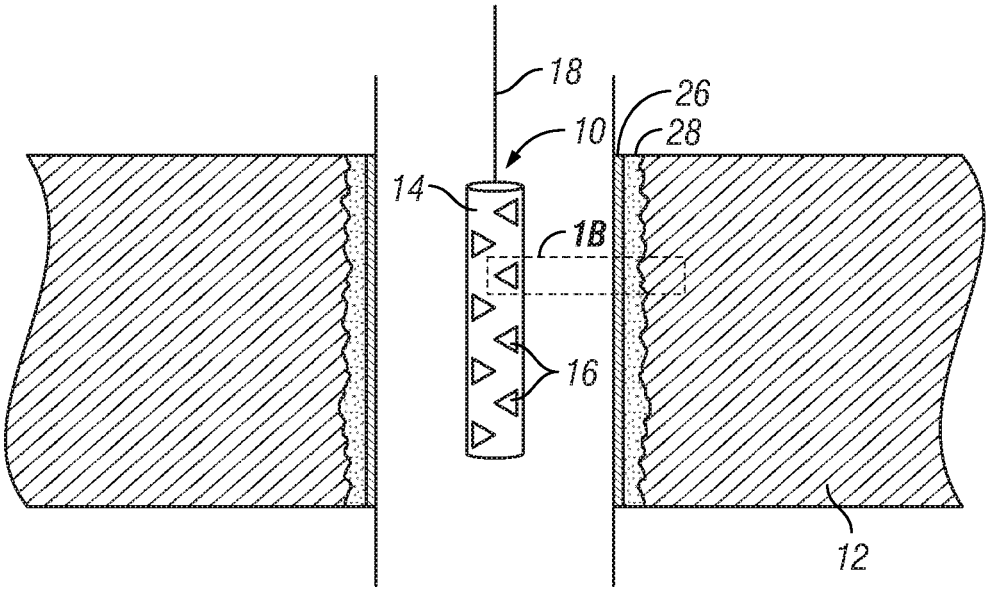
FIG. 1A (Prior Art)
FIG. 1A is a view of a typical perforating gun inside a well casing.
Figure 1B:
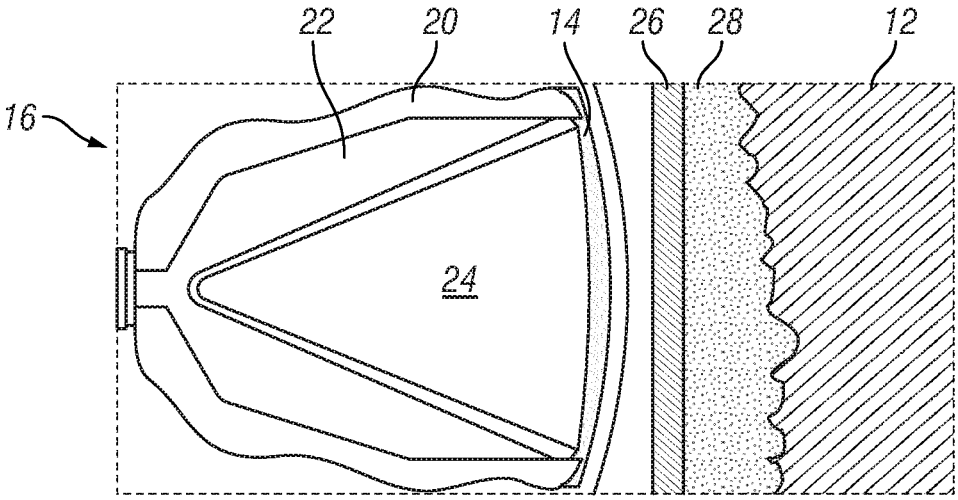
FIG. 1B (Prior Art)
FIG. 1B depicts a close-up cross-sectional view of a shaped charge of the perforating gun of FIG. 1A.
Figure 2:
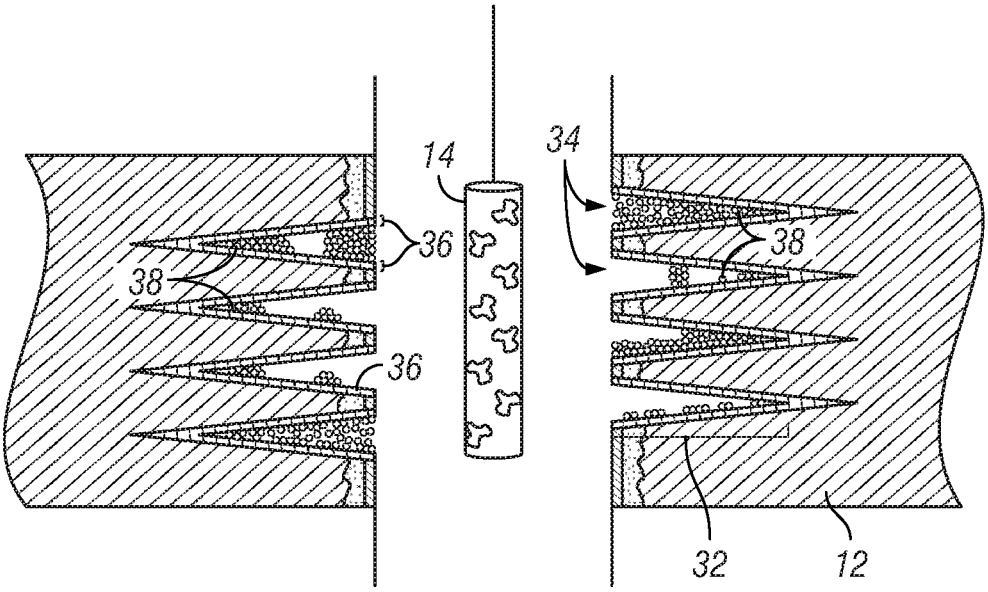
FIG. 2 (Prior Art)
FIG. 2 is a view of a typical conventional perforation device utilizing prior art methods after it has been detonated inside a well casing.

Where used in the various figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE PREFERRED EMBODIMENTS

The proposed invention involves an improved method for perforating a cased wellbore. The increase in depth and area of the resulting tunnels enhances injection parameters (e.g. pressure, rate) and the effects of injection (e.g. outflow rate, outflow distribution along wellbore, fracture creation). By removing debris from a high percentage of tunnels created during a perforating operation, the pressure required to inject fluids or gases during a subsequent injection operation is reduced. Further, the distribution of injected fluids or gases across the perforated interval is improved. By fracturing the tip of a perforation tunnel, the residual stress cage caused by plastic deformation of the rock during perforation is relieved. Consequently, a reduction in the fluid pressure required to initiate an hydraulic or gas-induced fracture during subsequent injection activity is achieved. The initiation of hydraulic fractures from a plurality of perforation tunnels arranged in different directions around the wellbore wherein a high percentage of the tunnels are free from obstruction minimizes the risk of near-wellbore pressure losses and tortuosity of the created fracture, reducing the amount of hydraulic horsepower required to effect a fracture stimulation. This increases the probability that the stimulation treatment can be executed to completion without risk of exceeding equipment limitations or encountering catastrophic loss of injectivity due to solids bridging (known as screenout).

Clean perforation tunnels in carbonate formations are conducive to the evolution of a single, deep wormhole during acidization whereas inadequately cleaned tunnels tend to result in shallower, branched wormholes delivering a relatively lower stimulation effect. Therefore, a high percentage of unobstructed tunnels is also beneficial to the acid stimulation of carbonate formations, or the injection of acid into carbonate rocks under conditions conducive to the creation of wormholes, for stimulations of the near-wellbore. Further beneficial injections are discussed below.

Figure 5:
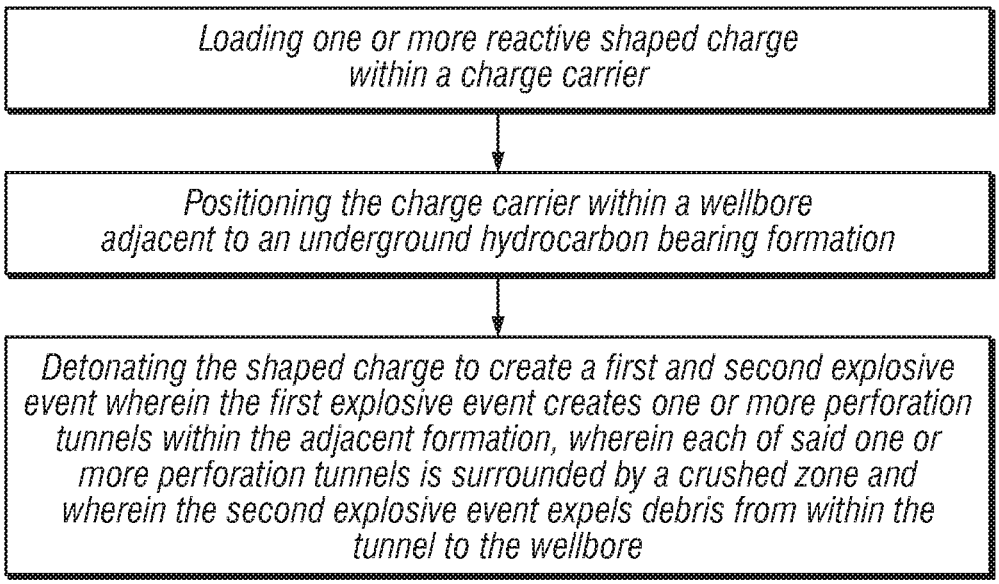
FIG. 5 is a flow chart depicting the method of the present invention.

The improved method for perforating a well for the enhancement of injection activities and stimulation of oil and gas production seen in FIG. 5 comprises the steps of loading one or more reactive shaped charge within a charge carrier; positioning the charge carrier within a wellbore adjacent to an underground hydrocarbon bearing formation; detonating the shaped charge to create a first and second explosive event, wherein the first explosive event creates one or more perforation tunnels within the adjacent formation, wherein each of said one or more perforation tunnels is surrounded by a crushed zone and wherein the second explosive event induces at least one fracture at the tip of at least one perforation tunnel. The second explosive event further expels debris from within the tunnel to the wellbore. Further, a stress cage caused by plastic deformation is relieved by the second explosive event, improving the quality of the tunnel and providing for subsequent enhanced stimulation of oil or gas.

As used herein, an explosive event is meant to include an induced impact event such as one caused by one or more powders used for blasting, any chemical compounds, mixtures and/or other detonating agents or any device that contains any oxidizing and combustible units, or other ingredients in such proportions, quantities, or packing that ignition by fire, heat, electrical sparks, friction, percussion, concussion, or by detonation of the compound, mixture, or device or any part thereof causes an explosion, or release of energy.

Preferably, at least one fracture is produced at the end of at least one perforation tunnel. As used herein, a fracture is an induced separation of the hydrocarbon-bearing formation extending a short distance from the tunnel that remains wholly or partially open due to displacement of the rock fabric or as a result of being propped open by rock debris.

Figure 6:
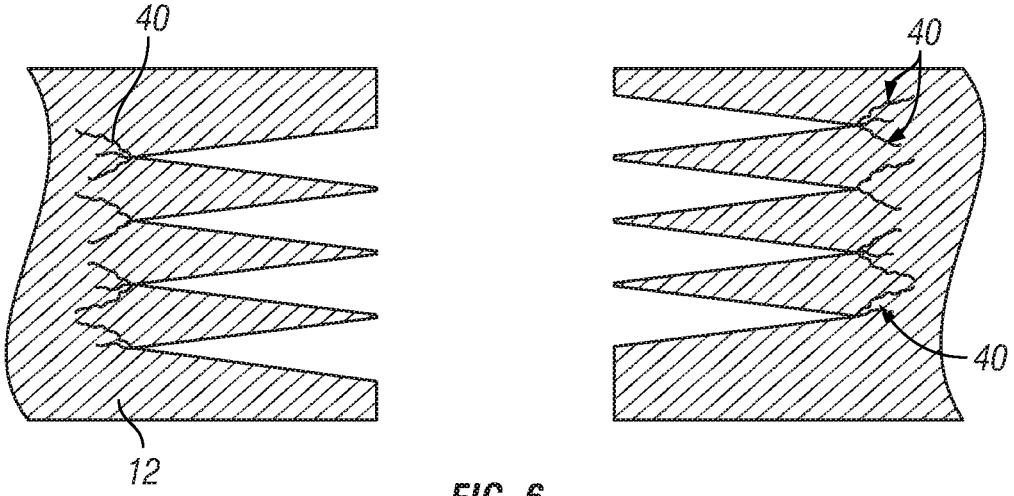
FIG. 6 is a cross-sectional view of the tunnels formed after a perforation device has been detonated utilizing the method of the present invention.
Figure 7:
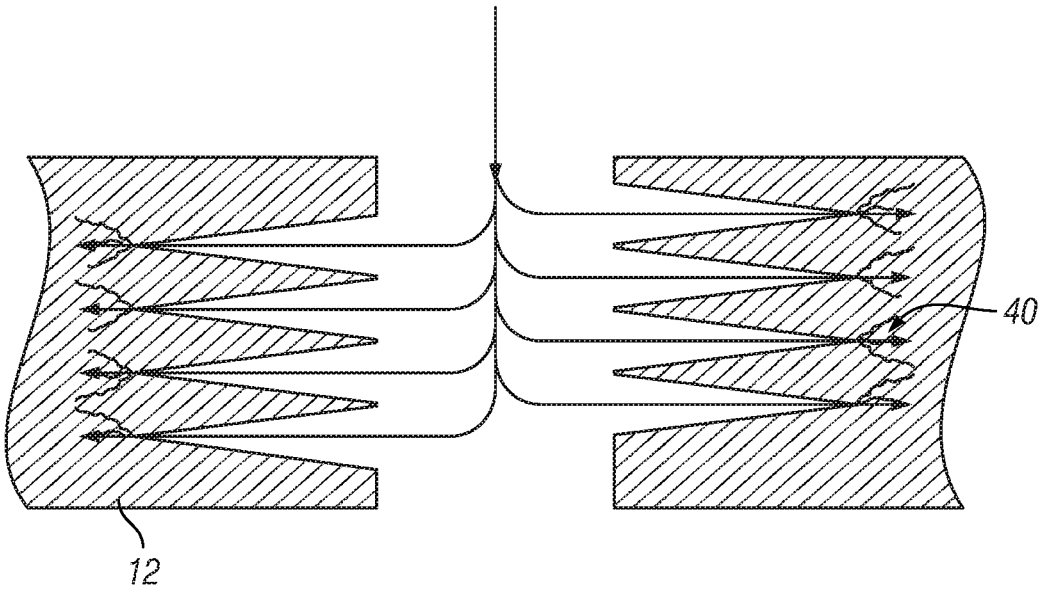
FIG. 7 is a cross-sectional view of the improved injection activities in a well bore after utilizing the method of the present invention.

FIG. 6 depicts a perforation device after it has been detonated inside a well casing utilizing the method of the present invention. The crushed zone 36, discussed above in relation to the prior art, is eliminated, removing a permeability barrier from the tunnel wall and making the cross-sectional diameter of the perforation tunnel wider by at least one quarter inch around the tunnel. Compacted debris is also expelled from the plugged tunnel tips due to the second explosive event, creating a more efficient and highly effective system for injection activities. The second explosive event is substantially contained with each of the perforation tunnels created by the first explosive event such that it is localized within each created tunnel. The introduction of this local effect to every perforation tunnel created by the perforation device results in the substantial elimination of the crushed zone from a high percentage of the created tunnels. This provides for even coverage of subsequently injected fluids throughout the tunnels of the wellbore, as seen in FIG. 7, and as shown by the following examples.

Example 1

The primary method for characterizing the near-wellbore region in order to compare the efficacy of the new and conventional perforating systems is a step rate test, carried out during a mini-frac (also known as a data frac) prior to the main stimulation treatment. The mini-frac is used to obtain a direct measurement of formation properties such as the breakdown gradient and fluid leak-off coefficient, so that the treatment design can be fine-tuned prior to execution. The step rate test involves pumping a constant fluid into the well at several distinct rates while measuring pump pressure. By combining this information with the other parameters calculated as a result of the mini-frac, near-wellbore pressure losses, perforation friction, and the number of open perforations can each be estimated.

Using the equation below, perforation friction pressure is predicted as a function of rate, the number of perforations taking fluid, the diameter of each perforation (obtained from manufacturers' surface tests), and the discharge coefficient. The discharge coefficient may be estimated from the perforation diameter, assuming a round perforation, or measured empirically during tests at surface.

$$P_{pf}=[1.975q^2\rho f]/C_D^2N_p^2d_p^4$$

where $P_{pf}$=Perforation friction pressure (in psi); q=Total pump rate; $\rho_f$=Slurry density; $C_D$=Perforation discharge coefficient; $N_p$=Number of open perforations; and $d_p$=Perforation diameter. Predicted pump pressure is plotted against measured pump pressure at each of the test rates. Since the other variables are essentially constant, the number of open perforations and the discharge coefficient can be iteratively adjusted until a good match is obtained between predicted and measured values.

Figure 4:
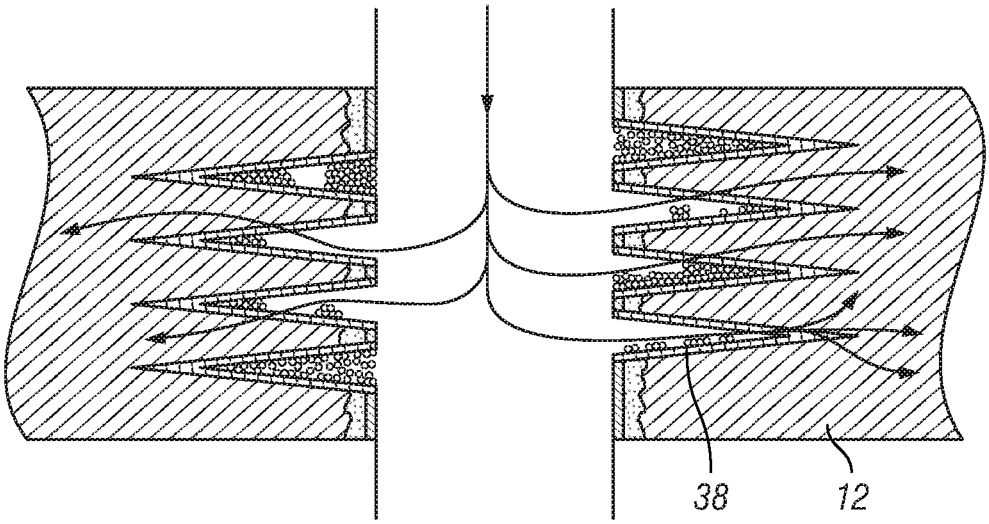
FIG. 4 (Prior Art)
FIG. 4 is a cross-section view of injection and stimulation of a wellbore for the production of oil and/or gas after perforation by typical prior art methods.

In this example, two wells completed at a depth of approximately 2,500 m in the Rock Creek sandstone formation in West Pembina were analyzed. Problems with excessive breakdown pressures are occasionally encountered in the wells of this area during perforation and hydraulic fracturing due to inadequate clean out of tunnels, resulting in tortuous paths, as described above with reference to FIG. 4. However, as evident by this example, wells perforated with the present invention exhibit a better fracture propagation gradient. Well A was perforated using a 3 m long, 3⅜ inch (86 mm) diameter, expendable hollow steel carrier loaded with regular, or conventional, 23 gram, deep penetrating charges at a density of 9 shots per meter, and 60-degree phasing. Well B was perforated with 4.5 m of 3⅜ inch (86 mm) diameter guns distributed across a gross interval of 35 m, loaded with reactive shaped charges at a density of 6 shots per meter, and 120-degree phasing. The total number of shots in each case was 27. Table 1 shows the formation breakdown pressure, breakdown pressure gradient, and fracture propagation gradient. As evident by Table 1, the data indicate that although Well B exhibited a much higher fracture propagation gradient (24.2 kPa/m versus 18.2 kPa/m), the breakdown gradient was actually less than that measured in Well A (26.9 kPa/m versus 28.0 kPa/m).

TABLE 1

Comparison of Critical Fracturing Parameters

| Property | Well A (Conventional Charge) | Well B (New Charge) |
|---|---|---|
| Bottom hole breakdown pressure | 72,000 kPa | 63,500 kPa |
| Breakdown gradient | 28.0 kPa/m | 26.9 kPa/m |
| Fracture propagation gradient | 18.2 kPa/m | 24.2 kPa/m |
| Incremental breakdown gradient | 9.8 kPa/m | 2.7 kPa/m |
| Open Holes/Total Shots | 5.2 of 27 | 7.4 of 27 |
| Perforating Efficiency | 19.3% | 27.4% |

Figure 8:
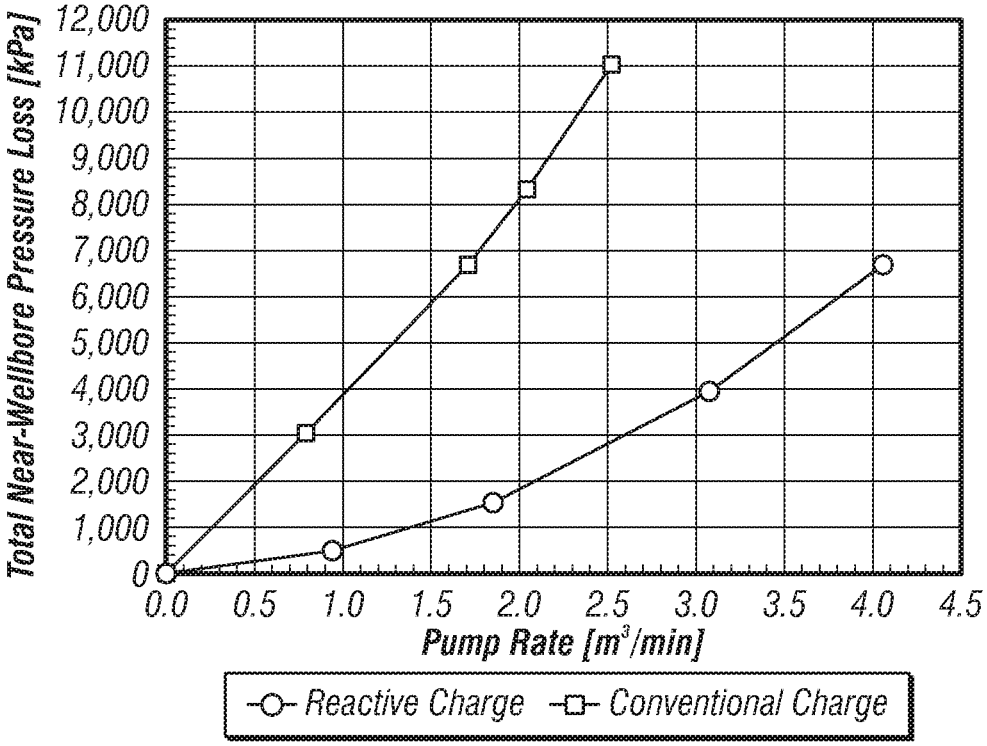
FIG. 8 depicts a graphical representation of one example of a comparison of the total near-wellbore pressure losses for conventional charges versus reactive charges calculated from a step-rate test.
Figure 9:
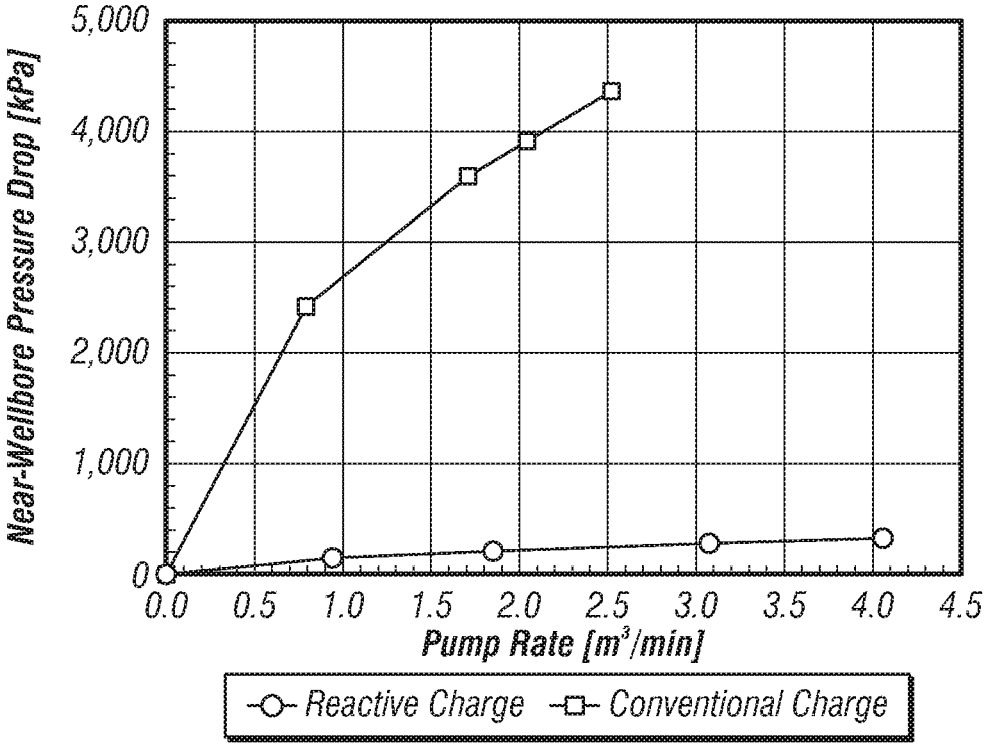
FIG. 9 is a graphical representation of one example comparing the calculated near-wellbore pressure drop ('tortuosity'), for conventional charges versus reactive charges.
Figure 10:
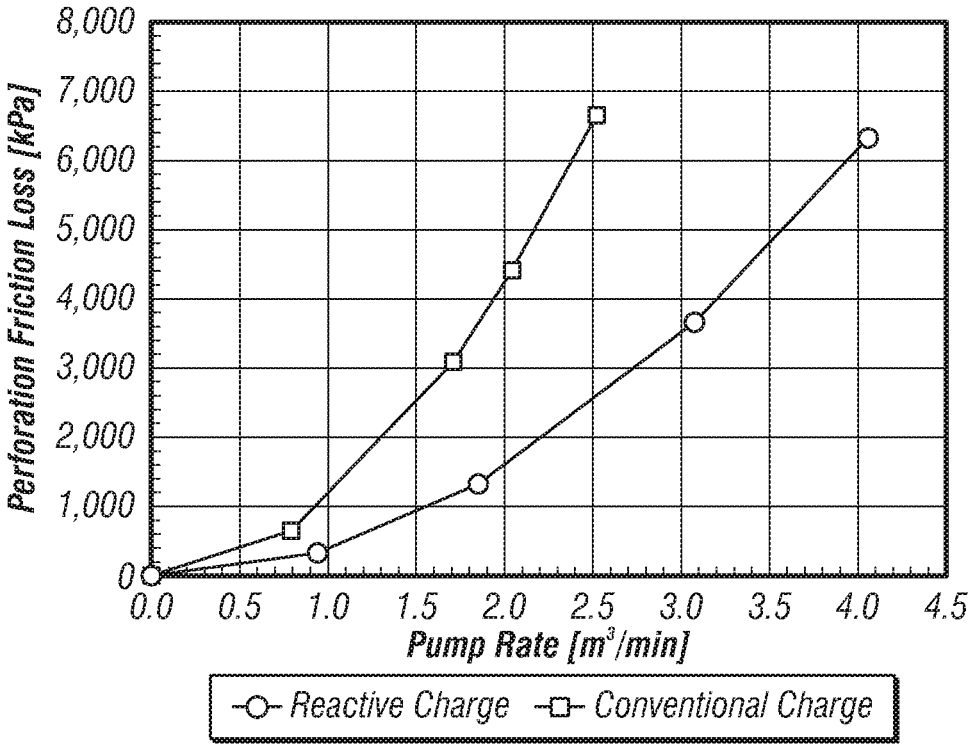
FIG. 10 is a graphical representation of one example comparing the calculated pressure losses due to perforation friction for conventional charges versus reactive charges.

FIG. 8 shows total near-wellbore pressure losses calculated from the step-rate test. At a typical treating rate of 2.5 $m^3$/min, Well B (reactive charge) experiences only 2,800 kPa pressure loss compared to 11,000 kPa in Well A (conventional charge). FIGS. 9 and 10 show the calculated pressure losses due to tortuosity (near-wellbore pressure loss) and perforation friction, respectively. Perforating with the reactive shaped charge almost eliminated tortuosity (<200 kPa at 2.5 $m^3$/min versus 4,300 kPa with the conventional charge) and significantly reduced the perforation friction (2,600 kPa at 2.5 $m^3$/min versus 6,700 kPa). The calculated number of open perforations is 5.2 for the regular charge (19.3% efficiency) and 7.4 for the reactive shaped charge (27.4%).

Since step-rate test interpretation involves iterative matching of a model to the field data, the results are dependent on the quality of data gathered and subject to a certain amount of engineering judgment. However, consistent application of the same methodology has confirmed similar results across multiple pairs of wells in the region and elsewhere.

Figure 11:
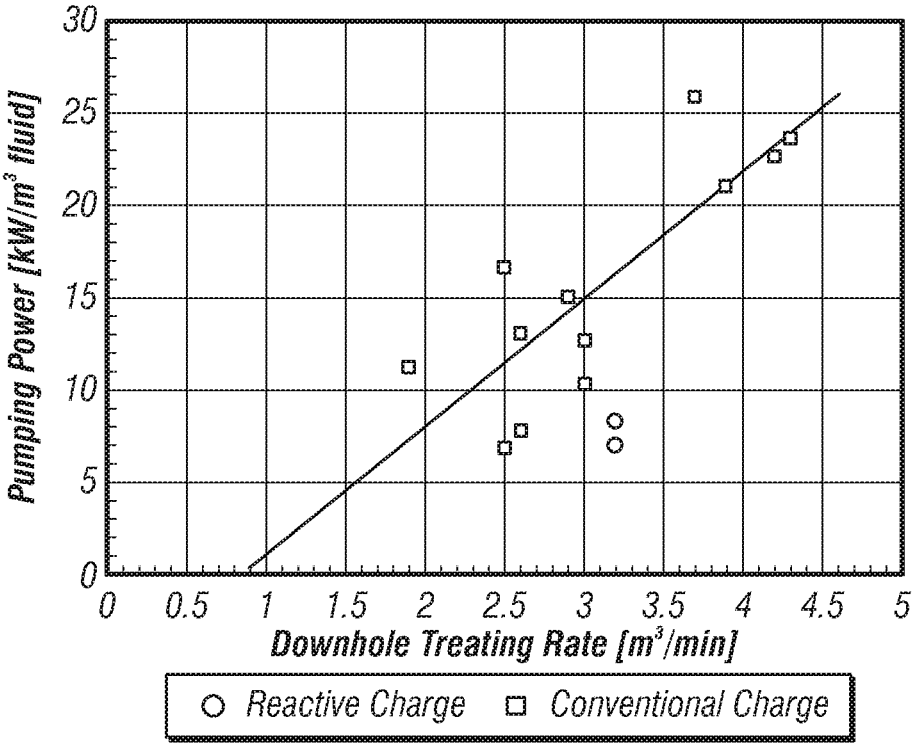
FIG. 11 is a graphical representation comparing the pumping power requirements of examples studied.

To further examine the impact of perforating with the new charges on hydraulic fracture treatment, an analysis has been conducted of treating power requirements against treating rate in the Cadomin formation, where elevated requirements for hydraulic horsepower historically increase the risk of equipment failure and incomplete treatment execution. FIG. 11 shows a crossplot of treating power against rate for the fifteen wells studied. Those wells perforated with the new charge clearly fall on the low side of the overall dataset, confirming our hypothesis that cleaner tunnels allow treatment at reduced pressure loss, and therefore use less hydraulic horsepower. Furthermore, the average breakdown pressure gradient was reduced by 41% (from 14.3 kPa/m for wells perforated with conventional charges to 8.4 kPa/m for wells perforated with the new charges) and the average treating gradient was reduced by 19% (from 16.2 kPa/m with conventional charges to 13.2 kPa/m with new charges).

Returning to the discussion of the present method and induction of the second explosive event or local reaction, in one embodiment, the elimination of a substantial portion of the crushed zone of the tunnel is created by inducing one or more strong exothermic reactive effects to generate near-instantaneous overpressure within and around the tunnel following the detonation of the shaped charges and creation of one or more perforation tunnels, the reactive effects can be produced by shaped charges having a liner manufactured partly or entirely from materials that will react inside the perforation tunnel, either in isolation, with each other, or with components of the formation. In one embodiment, the shaped charges comprise a liner that contains a metal, which is propelled by a high explosive, projecting the metal in its molten state into the perforation created by the shaped charge jet. The molten metal is then forced to react with water that also enters the perforation, creating a reaction locally within the perforation. For example, reactive shaped charges, suitable for the present invention are disclosed by in U.S. Pat. No. 7,393,423 to Liu, the technical disclosures of which are both hereby incorporated herein by reference. Liu discloses shaped charges having a liner that contains aluminum, propelled by a high explosive such as RDX or its mixture with aluminum powder. Another shaped charge disclosed by Liu comprises a liner of energetic material such as a mixture of aluminum powder and a metal oxide. Thus, the detonation of high explosives or the combustion of the fuel-oxidizer mixture creates a first explosion, which propels aluminum in its molten state into the perforation to induce a secondary aluminum-water reaction within micro seconds.

Figure 12A:
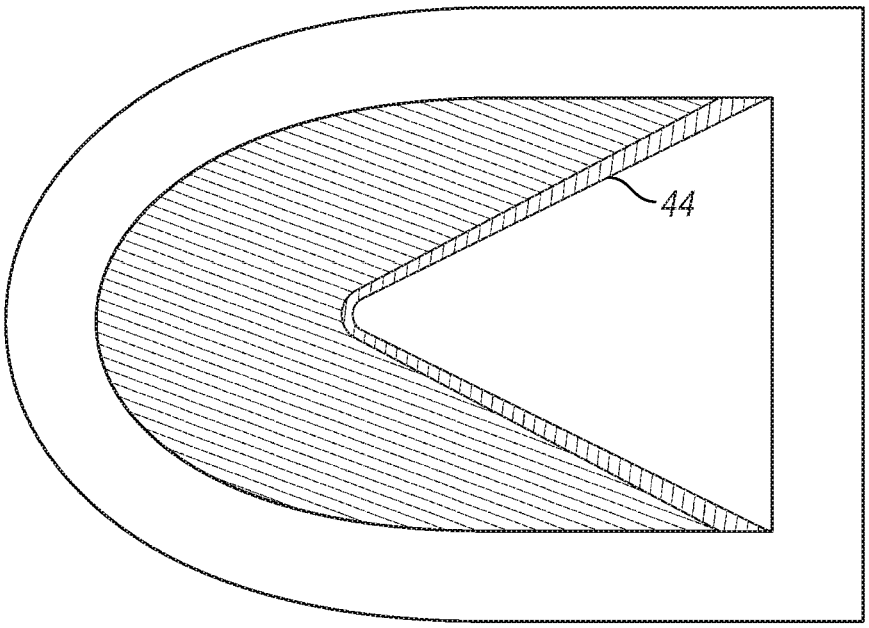
FIG. 12A is a cross-sectional view of one example of a charge carrier suitable for use with the present invention.

In a second embodiment, the shaped charges comprise a liner having a controlled amount of bimetallic composition which undergoes an exothermic intermetallic reaction. In another embodiment, the liner is comprised of one or more metals that produce an exothermic reaction after detonation. For example, U.S. Patent Application Publication No. 2007/0056462 to Bates et al., the technical disclosures of which are both hereby incorporated herein by reference, disclose a reactive shaped charge, shown in FIG. 12A, comprising a reactive liner, 44 made of at least one metal and one non-metal, or at least two metals which form an intermetallic reaction. Typically, the non-metal is a metal oxide or any non-metal from Group III or Group IV, while the metal is selected from Al, Ce, Li, Mg, Mo, Ni, Nb, Pb, Pd, Ta, Ti, Zn, or Zr. After detonation, the components of the metallic liner react to produce a large amount of energy, typically in the form of heat. The highly exothermic reaction of Bates is said to generate pressures in the 50,000 to 80,000 psi range, however, any reaction that expels the debris from the perforation tunnels to the wellbore is sufficient so long as it is triggered by or caused to be triggered by the first explosive event. Preferably, the second, local reaction will take place almost instantaneously following detonation of the perforation gun, with complete formation of the tunnel prior to the secondary energy release, or explosive event.

Figure 3A:
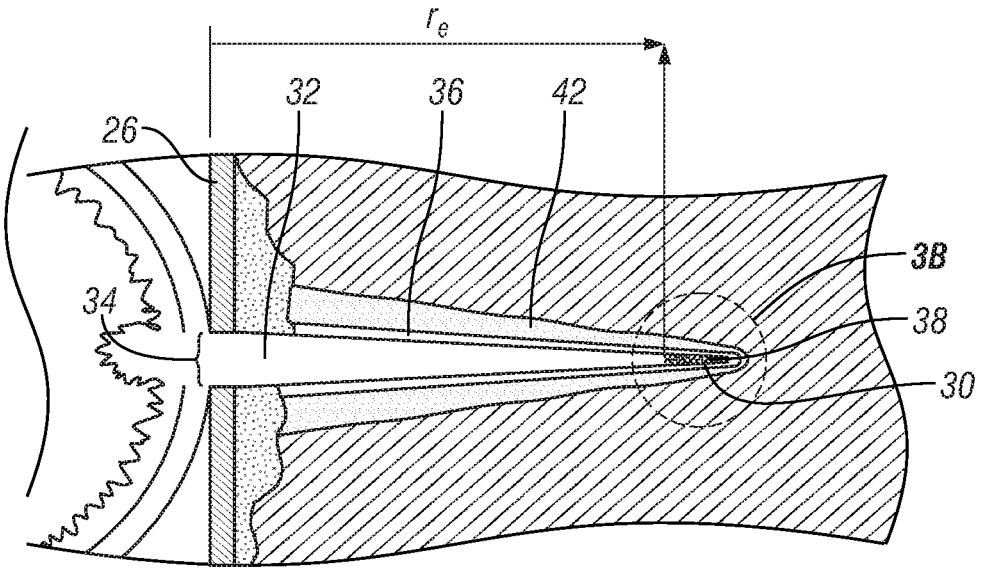
FIG. 3A (Prior Art)
FIG. 3A is a cross-sectional view of the formation of FIG. 1 after it is perforated by a typical shaped charge.
Figure 3B:
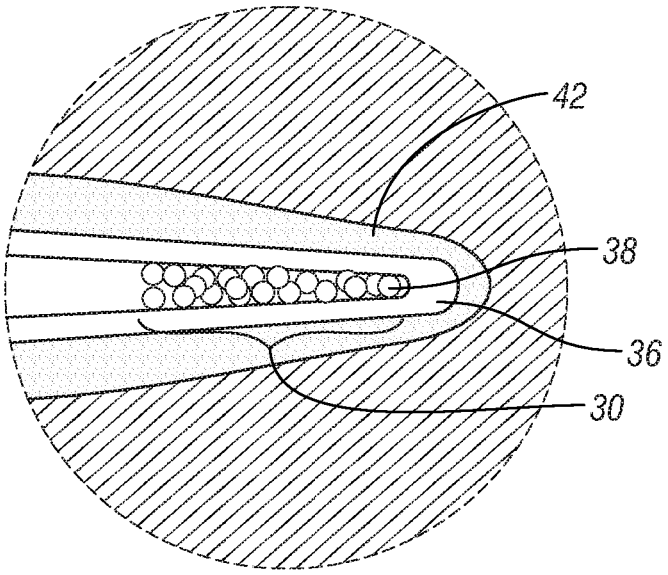
FIG. 3B (Prior Art)
FIG. 3B depicts an enlarged view of the damage mechanisms experienced within and around the tip of the perforation tunnel in FIG. 3A as a result of prior art methods.
Figure 12B:
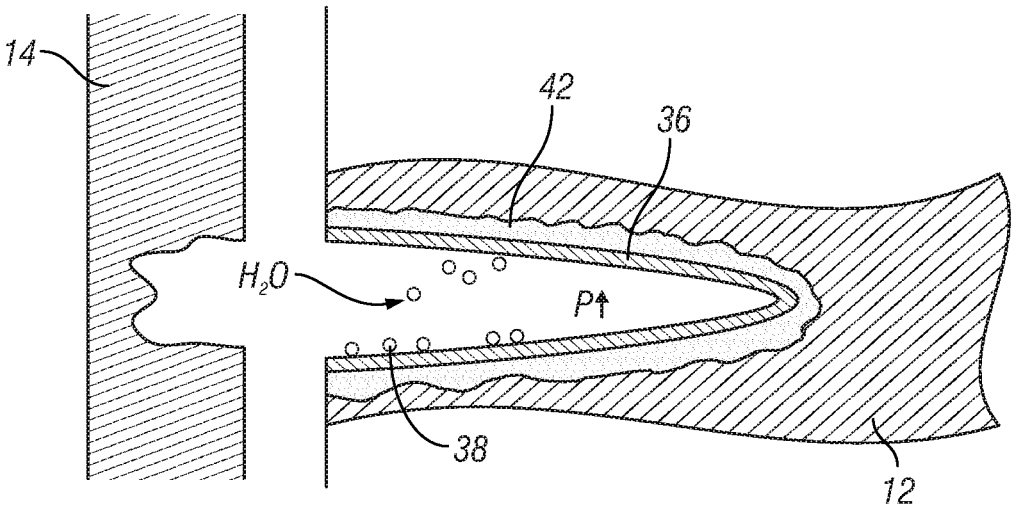
FIG. 12B illustrates a cross-sectional close up view of a perforation tunnel created after a reactive charge is blasted into a hydrocarbon bearing formation.
Figure 12C:
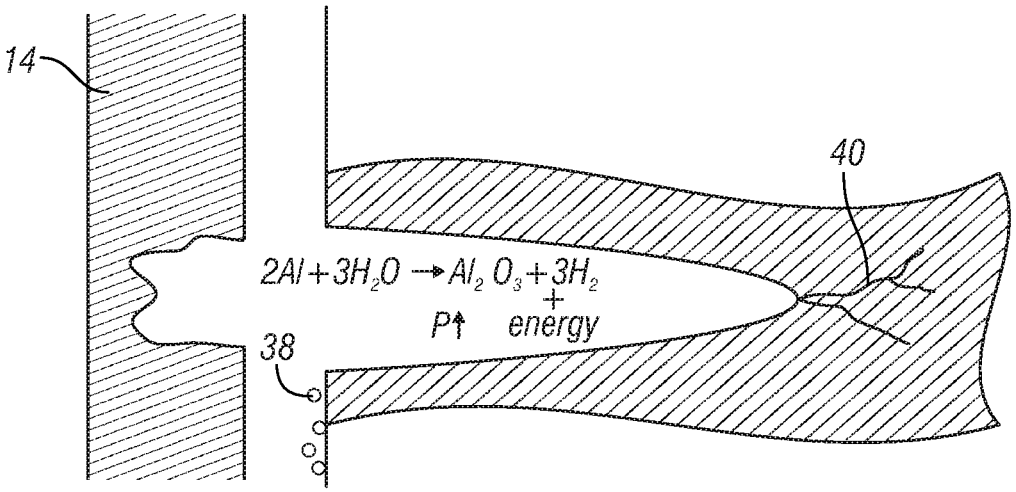
FIG. 12C is a cross-sectional close up view of the perforation tunnel of FIG. 12B after the secondary explosive reaction has occurred.

Without being bounded by theory, FIGS. 12B-12C depict the theoretical process that occurs within the hydrocarbon-bearing formation 12 as a reactive charge comprising an aluminum liner is activated. As shown in FIG. 12B, the activated charge carrier 14 has fired the reactive charge into the formation 12 and has formed a tunnel surrounded by the crushed zone 36, described above. Because the liner is comprised of aluminum, molten aluminum from the collapsed liner also enters the perforation tunnel. After detonation, the pressure increase induces the flow of water from the well into the tunnel, creating a local, secondary explosive reaction between aluminum and water, eliminating the crushed zone 36 and preferably forming a fracture 40 at the end of the tunnel, as shown in FIG. 12B. By way of example, FIG. 3B depicts a contrasting close-up view of a perforating tunnel produced by prior art methods. Compacted fill at the tip 30 of the tunnel forms a barrier to injection, while plastic deformation at 42 forms a residual stress cage, increasing resistance to fracturing. The crushed zone 36 reduces permeability at the tunnel wall and forms a barrier to injection. In contrast, as seen in FIG. 12B, there is no crushed zone 36 and no compacted fill 30 formed by debris 38.

Since every reactive shaped charge independently conveys a discrete quantity of reactive material into its tunnel, the cleanup of any particular tunnel is not affected by the others. The effectiveness of cleanup is thus independent of the prevailing rock lithology or permeability at the point of penetration. Consequently, a very high perforation efficiency is achieved, theoretically approaching 100% of the total holes perforated, within which the clean tunnel depth will be equal to the total depth of penetration (since compacted fill is removed from the tunnel). Tunnels perforated are highly conducive to injection under fracturing conditions for disposal and stimulation purposes, with uniformity of distribution of the injection fluid across perforation intervals. The present invention has been successfully applied in wells with <0.001 mD up to >100 mD permeability.

By substantially eliminating the crushed zone, reactive perforators shot into moderate to hard rock under realistic confining stress increase the quality of the tunnel and yield a number of benefits for injection stimulation. The removal of the crushed zone results in a very high percentage of unobstructed tunnels, which in turn results in: an increased rate of injection at a given injection pressure; a reduced injection pressure at a given injection rate; a reduced injection rate per open perforation (less erosion); an improved distribution of injected fluids across the perforated interval; a reduced propensity for catastrophic loss of injectivity due to solids bridging (screen out) during long periods of slurry disposal or during proppant-bearing stages of an hydraulic fracture stimulation; the minimization of near-wellbore pressure losses; and an improved predictability of the outflow area created by a given number of shaped charges (of specific value to limited entry perforation for outflow distribution control). As little as a 10% increase in injection rate during fracture stimulation is known to create a sufficient improvement in fracture geometry for a valuable increase in well productivity to occur. As a result of removing the residual stress cage around the tunnel, fracture initiation pressures can be significantly lowered. This reduction is particularly advantageous and valuable to well operators as stimulation service providers typically charge according to the amount of hydraulic horsepower applied and the peak pressure applied during a treatment. In addition, lower pressures result in less risk of equipment damages, less wear-and-tear, and lower maintenance costs. In some cases, fracture initiation pressures can be lowered to the point where a formation that could not previously be fractured using conventional wellsite equipment can now be fractured satisfactorily for enhanced injection activities.

The benefits of the present invention and the enhanced injection activities it provides for are numerous. Among those are the enhancement of injection activities directed to water-based or oil-based fluids and slurries for disposal, under matrix injection conditions or under fracturing conditions; the injection of gas for disposal; the injection of water for voidage replacement and/or reservoir pressure maintenance, under matrix injection conditions or under fracturing conditions; the injection of gas for voidage replacement and/or reservoir pressure maintenance; the injection of water-based or oil based fluids for stimulation of the near-wellbore rock matrix, such as brines, acids, bases, gels, emulsions, enzymes, chemical breakers, and polymers. As used herein, matrix injections refer to injections below the pressure at which the formation breaks and a fracture is created, thereby causing fluid to flow into a pore space (rock matrix). Fracturing conditions are meant to refer to injections above the pressure at which formation breaks and a fracture is created and propagated, thereby resulting in fluid predominantly flowing into the created fracture.

Using the method of the present invention, injection of water-based or oil-based fluids is also beneficially used to enhance the sweep of hydrocarbons from the reservoir and increase oil recovery, such as treated water, steam, gels, emulsions, enzymes, active microbial cultures, surfactants, and polymers. Moreover, the method provides for further injection of water-based or oil-based fluids at rates and pressures sufficient to propagate hydraulic fractures (for example, rates may range from <1 to 200 bbl/min and pressures may range from <1000 to 30,000 psi), on occasion including a solid phase that will be transported into the created fracture so as to maintain the conductivity of the fracture after injection has ceased. In addition, the method provides for the injection of gases at rates and pressures sufficient to induce fracture creation for the purpose of enhancing the inflow or outflow potential of the well, such gases being injected from the surface or generated in the wellbore by the combustion of propellants or other gas-generating material concurrent with, or at some time after, the perforating event. Finally, the present invention enhances the distribution of injection points along the wellbore, and the provision of injection points providing a specific flow area at said points along the wellbore, for the purpose of controlling the outflow distribution of injected fluid along the wellbore.

Example 2

The Upper Devonian sequence in Pennsylvania constitutes one of the most complex sequences of rocks in the Appalachian basin. This region comprises interbedded conglomerates, sandstones, siltstones and shales. Of the commonly targeted intervals, the wells of the Bayard and Fifth sands are notoriously difficult to complete in certain areas. High fracture initiation and treating pressures are a common occurrence, often resulting in negligible propped fracture creation and correspondingly poor productivity. The Bayard consists of up to three fine-grained sandstones separated by thin shale breaks. The sands range from 3 to 35 feet in thickness and are recognized as important gas reservoirs. Wells encountering well-developed Bayard have tested up to 3 min mcf/d from this zone. The Fifth sand is a persistent and important rock sequence, responsible for both oil and gas production in the area. In gas prone areas, the Fifth tends to be multi-layered, fine- to coarse-grained sandstone containing conglomeratic streaks and lenses. The zone as a whole varies from under 10 feet to over 40 feet thick.

A variety of completion techniques have been attempted on these two zones, starting with drilling fluid and cement designs that minimize filtrate loss—since fluid loss appears to correlate with difficulties breaking the formation. One of the more commonly applied techniques has been to open hole fracture the Bayard and Fifth before running casing to complete deeper intervals. While occasionally successful, the incremental cost of separate fracturing operations jeopardizes well economics. Several different acid recipes have also been investigated to help overcome breakdown difficulties. Other intervals in the area are typically treated with 12-3 HCl/HF ahead of the fracturing fluid, but laboratory studies showed that this combination creates an insoluble precipitate when applied to samples from the Bayard and Fifth. 25% hydrochloric acid has subsequently become the default acid for these zones.

By delivering clean, open tunnels with fractured tunnel tips, the method of the present invention helps reduce breakdown and treating pressures—often enabling fracture stimulation of zones that were considered untreatable. The method of the present invention was applied on four wells and fracturing performance was subsequently compared to seven offset wells perforated with conventional charges in close geographic proximity. All four wells encountered Bayard reservoir although in the third well it was only 4 feet thick. Three of the four wells encountered Fifth sand sufficient for completion. Significant reductions in breakdown and treating pressures were observed in both zones. Treating rates were dramatically improved, allowing for the pumping away of as much proppant as was available on location. Based on the results that follow, operators in these regions can plan larger fracture treatments for these zones in future wells.

Figure 13:
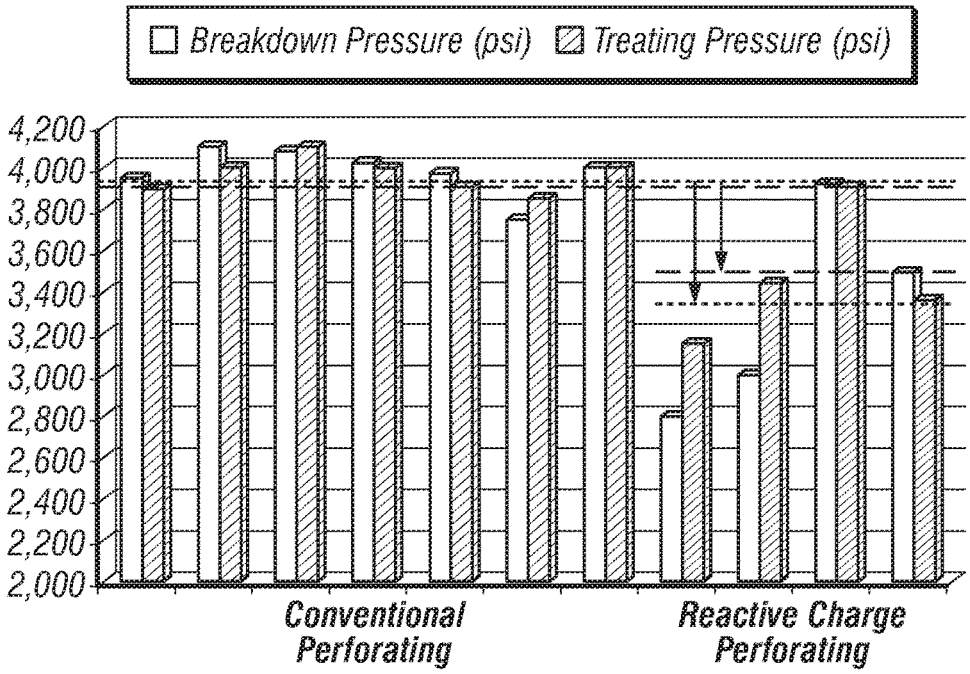
FIG. 13 is a bar graph relating to Example 2 and depicts average breakdown pressure (x-axis) and average treating pressure versus type of charge used.
Figure 14:
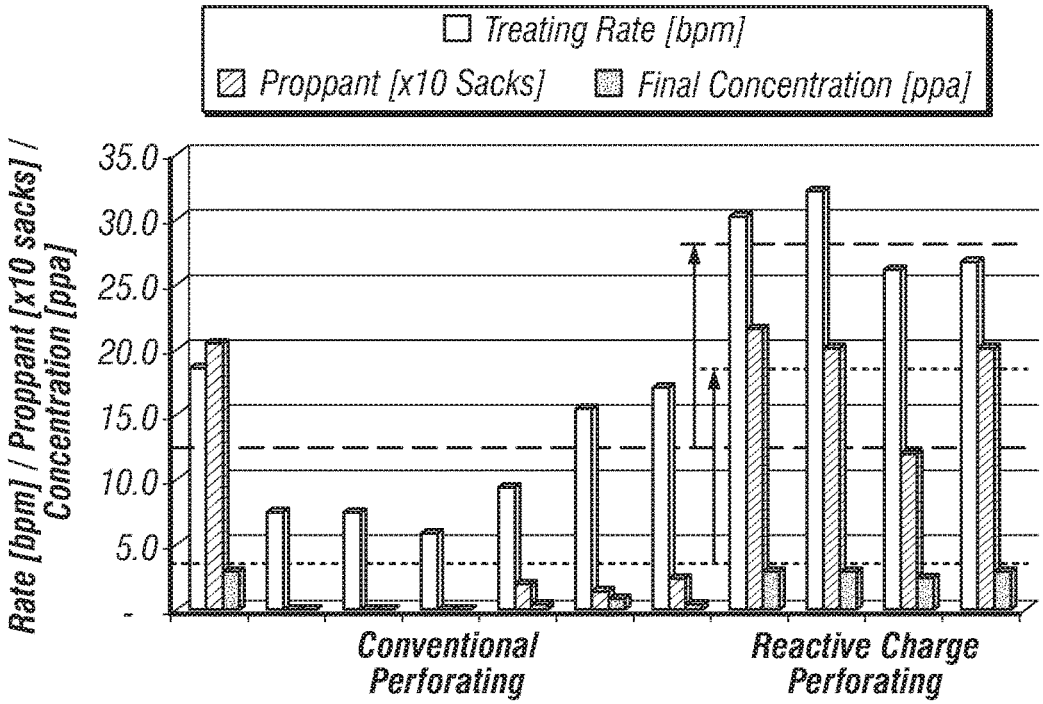
FIG. 14 is a bar graph relating to Example 2 and depicts rate of proppant placed (x-axis) versus type of charge used.
Figure 15:
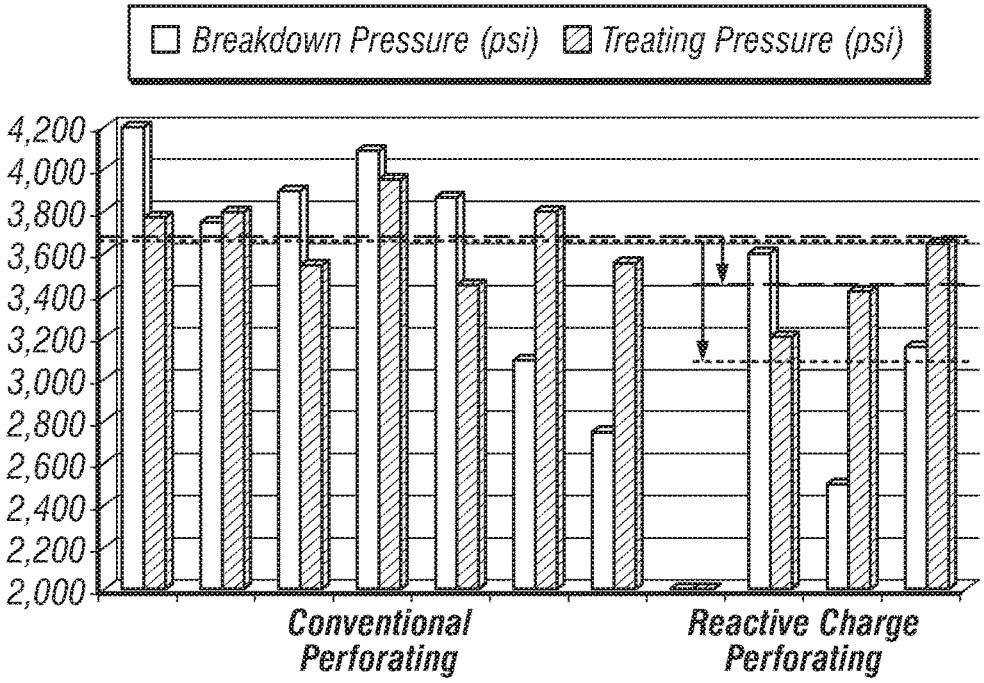
FIG. 15 is a bar graph relating to Example 2 and depicts average breakdown pressure (x-axis) and average treating pressure versus type of charge used.
Figure 16:
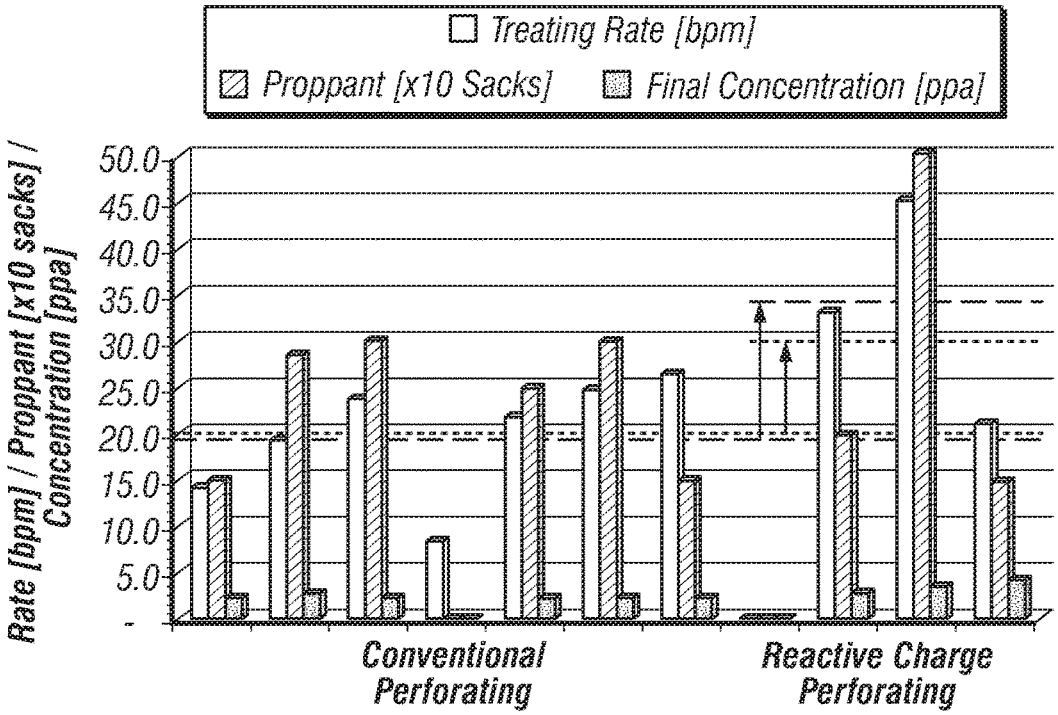
FIG. 16 is a bar graph relating to Example 2 and depicts rate of proppant placed (x-axis) versus type of charge used.

As shown in FIG. 13, all of the Bayard intervals treated significantly better than offset wells. The average breakdown pressure was reduced by 675 psi (17%) and the average treating pressure was reduced by 505 psi (13%). If data from the third well are excluded (due to the extremely thin Bayard section encountered), the reductions become 850 psi (22%) and 650 psi (16%), respectively. In FIG. 14, the average treating rate increased 2.5 fold. The average proppant volume placed increased almost 5 fold. In fact, on several of the offset wells sufficient rate was never achieved for a meaningful amount of proppant to be introduced. FIGS. 15 and 16 demonstrate how the three Fifth zones also treated significantly better than offset wells. As shown in FIG. 15, the average breakdown pressure was reduced by 600 psi (16%) and the average treating pressure was reduced by 275 psi (8%). These averages include unusually low breakdown pressures reported for two conventionally perforated wells. The average treating rate, seen in FIG. 16, increased 1.7 fold. The average proppant volume placed increased 1.4 fold and was limited on two of the wells by material available on location. On the second well, twice the normal amount of proppant was taken to location and successfully pumped. As with the Bayard, in contrast with wells perforated with the present invention, many of the offset wells never achieved sufficient rate for a meaningful amount of proppant to be introduced.

Even though the figures described above have depicted all of the explosive charge receiving areas as having uniform size, it is understood by those skilled in the art that, depending on the specific application, it may be desirable to have different sized explosive charges in the perforating gun. It is also understood by those skilled in the art that several variations can be made in the foregoing without departing from the scope of the invention. For example, the particular location of the explosive charges can be varied within the scope of the invention. Also, the particular techniques that can be used to fire the explosive charges within the scope of the invention are conventional in the industry and understood by those skilled in the art.

It will now be evident to those skilled in the art that there has been described herein an improved perforating method that reduces the amount of debris left in the perforations in the hydrocarbon bearing formation after the perforating gun is fired and enhances injection activities in the production of oil and gas. Although the invention hereof has been described by way of preferred embodiments, it will be evident that other adaptations and modifications can be employed without departing from the spirit and scope thereof. The terms and expressions employed herein have been used as terms of description and not of limitation; and thus, there is no intent of excluding equivalents, but on the contrary it is intended to cover any and all equivalents that may be employed without departing from the spirit and scope of the invention.

What is claimed is:

1. A method for perforating a well and for the enhancement of injection activities and stimulation of oil or gas production in an underground formation, the method comprising the steps of:

a) loading a reactive liner shaped charge within a charge carrier, the reactive liner shaped charge having a reactive liner comprising at least three components selected from metals and oxides of metals such that the reactive liner is subject to explosive exothermic intermetallic reaction under detonation conditions caused by a high explosive;

b) positioning the charge carrier down a wellbore adjacent to the underground formation, the underground formation including interbedded conglomerates, sandstones, and shales; and c) detonating a high explosive in the reactive liner shaped charge to cause a first explosive event;

d) triggering a second explosive event as a result of the first explosive event, the second explosive event created by exothermic intermetallic interaction between reactive liner components, the explosive events clearing the perforation tunnel of an internal crush zone to produce a clear tunnel depth having an improved permeability as compared to permeability with the crush zone in place; and e) injecting a fluid into the wellbore to fracture the underground formation;

whereby the method reduces a fluid pressure required to initiate the step of fracturing of the underground formation as compared to using a charge without a reactive liner.

2. The method of claim 1, wherein the perforation tunnel includes a fracture at a tip of the perforation, and further comprising stimulating the formation by forcing injected fluid out of the perforation tunnel through the fracture at the tip of the perforation tunnel into the underground formation.

3. The method of claim 1, wherein a depth of the clear tunnel is equal to the total depth of penetration of the perforation tunnel.

4. The method of claim 1, whereby the step of injecting fluids is at an increased fluid injection rate as compared to using a charge without a reactive liner.

5. The method of claim 1, whereby a distribution of injected fluids across the underground formation is improved as compared to using a charge without a reactive liner.

6. The method of claim 1, wherein the step of injecting comprises injecting a fluid selected from the group consisting of brines, acids, bases, gels, emulsions, enzymes, chemical breakers, and polymers.

7. The method of claim 1, wherein the at least three components of the reactive liner shaped charge are selected from Al, Ce, Li, Mg, Mo, Ni, Nb, Pb, Pd, Ta, Ti, Zn, and Zr.

8. The method of claim 1, wherein the the reactive liner shaped charge, further includes a component selected from the Group IV elements.

9. A method for perforating a well for the enhancement of injection activities and stimulation of oil or gas production in an underground formation, said method comprising the steps of:

a) loading a plurality of reactive liner shaped charges within a charge carrier, each of the plurality of reactive shaped charges, each charge including a reactive liner formed from at least two metallic components that react with each other explosively under detonation conditions of a high explosive charge;

b) positioning the charge carrier down a wellbore adjacent to the underground formation, wherein the underground formation includes interbedded conglomerates, sandstones, and shales; and c) detonating a high explosive in each of the plurality of reactive liner shaped charges, each step of detonating creating a first explosive event in each of the plurality of reactive liner shaped charges, each first explosive triggering a second explosive event in each of the plurality of reactive liner shaped charges, the first and second explosive events each creating a perforation tunnel, clearing the created perforation tunnel of debris and creating a fracture at the tip of the perforation tunnel;

whereby the method reduces a fluid pressure required to initiate an hydraulic fracture relative to methods using charges without a reactive liner.

10. The method of claim 9, wherein the reactive liner comprises a metal selected from Al, Ce, Li, Mg, Mo, Ni, Nb, Pb, Pd, Ta, Ti, Zn, or Zr.

11. The method of claim 10, wherein the reactive liner further comprises a non-metal of Group IV.

12. The method of claim 9, wherein the perforation includes a fracture at a tip of the perforation, and further comprising stimulating the formation by forcing injected fluid out of the perforation tunnel through the fracture at the tip of the perforation tunnel into the underground formation.

13. The method of claim 9, wherein the second explosive event clears a crush zone of the perforation tunnel to produce a clear tunnel depth having an improved permeability as compared to a permeability with crush zone in place.

14. The method of claim 9, further comprising a step of injecting fluids after the step of detonating; whereby the step of injecting fluids is at an increased fluid injection rate as compared to a method using a charge without a reactive liner.

15. The method of claim 14, whereby a distribution of injected fluids across the underground formation is improved as compared to using a charge without a reactive liner.

16. The method of claim 9, further comprising, after clearing the created perforation tunnel of debris and creating a fracture at the tip of the perforation tunnel, injecting a fluid selected from the group consisting of brines, acids, bases, gels, emulsions, enzymes, chemical breakers, and polymers into the perforation tunnel.

17. A method for perforating a well and minimizing near wellbore pressure losses during injection and stimulation of oil or gas production in an underground formation, said method comprising the steps of:

a) loading a reactive liner shaped charge within a charge carrier, the reactive liner shaped charge having a reactive liner, the reactive liner comprising at least two metals selected to react with each other exothermically;

b) positioning the charge carrier down a wellbore adjacent to the underground formation, the formation including interbedded conglomerates, sandstones, and shales, or carbonates; and c) detonating a high explosive in the reactive liner shaped charge to create a first explosive event;

d) triggering a second explosive event by energy of the first explosive event, wherein the second explosive event is created by exothermic interaction between the at least two metals of the reactive liner, the first and second explosive events creating a perforation tunnel in the underground formation, clearing the perforation tunnel of debris and inducing at least one fracture at a tip of the perforation tunnel; and e) injecting a fluid into the perforation tunnel under pressure to stimulate oil or gas production;

wherein the detonating of the reactive liner shaped charge minimizes near wellbore pressure losses during fluid injection, relative to methods using a charge without a reactive liner.

18. The method of claim 17, wherein the at least two metals are selected from Al, Ce, Li, Mg, Mo, Ni, Nb, Pb, Pd, Ta, Ti, Zn, or Zr.

19. The method of claim 18, wherein the reactive liner further comprises a non-metal of Group IV.

20. The method of claim 17, wherein the perforation includes a fracture at a tip of the perforation, and further comprising stimulating the formation by forcing injected fluid out of the perforation tunnel through the fracture at the tip of the perforation tunnel into the underground formation.

21. The method of claim 17, wherein the second explosive event clears a crush zone of the perforation tunnel to produce a clear tunnel depth having an improved permeability as compared to permeability with crush zone in place.

22. The method of claim 17, further comprising a step of injecting fluids after the step of detonating; whereby the step of injecting fluids is at an increased fluid injection rate as compared to a method using a charge without a reactive liner.

23. The method of claim 22, whereby a distribution of injected fluids across the underground formation is improved as compared to using a charge without a reactive liner.

24. The method of claim 17, wherein the step of injecting comprises injecting a fluid selected from the group consisting of brines, acids, bases, gels, emulsions, enzymes, chemical breakers, and polymers into the perforation tunnel.

25. A method for perforating a well for the enhancement of injection activities and stimulation of oil or gas production in an underground formation, said method comprising the steps of:

a) loading a reactive liner shaped charge within a charge carrier, the reactive liner shaped charge having a reactive liner, the reactive liner comprised of at least two metals selected to react with each other exothermically;

b) positioning the charge carrier down a wellbore adjacent to the underground formation, the formation including interbedded conglomerates, sandstones, and shales;

c) detonating a high explosive in the reactive shaped charge to create a first explosive event;

d) triggering a second explosive event by the first explosive event, wherein the second explosive event is caused by exothermic reaction between the at least two metals of the reactive liner, the explosive events producing a perforation tunnel having a fracture at a tip of the perforation tunnel;

whereby the method reduces the pressure required to initiate an hydraulic fracture, relative to a method using a charges without a reactive liner.

26. The method of claim 25, wherein the at least two metals are selected from Al, Ce, Li, Mg, Mo, Ni, Nb, Pb, Pd, Ta, Ti, Zn, or Zr.

27. The method of claim 26, wherein the reactive liner further comprises a non-metal of Group IV.

28. The method of claim 25, wherein the wellbore has a reduction of near-wellbore pressure loss of 75%, as compared to a method using charges without a reactive liner.

29. The method of claim 28, further comprising stimulating the formation by forcing injected fluid out of the perforation tunnel through the fracture at the tip of the perforation tunnel into the underground formation.

30. The method of claim 25, wherein the second explosive event clears a crush zone inside the perforation tunnel and thereby creates a clear tunnel.

31. The method of claim 25, further comprising a step of injecting fluids after the second explosive event, whereby the step of injecting fluids is at an increased fluid injection rate as compared to a method using a charge without a reactive liner.

32. The method of claim 31, whereby a distribution of injected fluids across the underground formation is improved as compared to using a charge without a reactive liner.

33. The method of claim 25, further comprising, after the step of triggering and producing a perforation tunnel, a step of injecting a fluid selected from the group consisting of brines, acids, bases, gels, emulsions, enzymes, chemical breakers, and polymers into the perforation tunnel.

* * * * *